United States Patent [19]

Workman

[11] Patent Number: 4,751,861

[45] Date of Patent: Jun. 21, 1988

[54] DEVICE FOR LOOSENING METAL SCREW CAPS

[76] Inventor: Wells S. Workman, Transv. 29, #39 B 22, Bogota, Colombia

[21] Appl. No.: 40,916

[22] Filed: Apr. 21, 1987

[51] Int. Cl.[4] ..... B67B 7/18

[52] U.S. Cl. ..... 8/3.07

[58] Field of Search ..... 81/3.07, 3.4

[56] References Cited

U.S. PATENT DOCUMENTS

| | | |
|---|---|---|
| 2,235,313 | 3/1941 | Cleveland . |
| 2,811,062 | 10/1957 | Robertson . |
| 2,931,258 | 4/1960 | Ronning, Jr. . |
| 2,985,045 | 5/1961 | Grasty et al. . |
| 3,122,950 | 3/1964 | Fredrickson . |
| 3,600,982 | 8/1971 | Tholen . |
| 3,919,901 | 11/1975 | Braman . |
| 4,058,031 | 11/1977 | Magarian . |
| 4,509,784 | 4/1985 | Vollers . |
| 4,519,276 | 5/1985 | Grabarski et al. . |

*Primary Examiner*—Roscoe V. Parker

*Attorney, Agent, or Firm*—Pennie & Edmonds

[57] ABSTRACT

A device for loosening a metal screw cap is disclosed. A housing able to fit over the screw cap of a jar, bottle, or other container has an inner and an outer wall defining a chamber therebetween. An element for heating the metal screw cap are provided in the chamber, preferably a magnetizing coil wound around an outside surface of the inner wall which can induce high currents in the cap, thus loosening the cap for easy removal by hand or with the aid of the device.

5 Claims, 1 Drawing Sheet

DEVICE FOR LOOSENING METAL SCREW CAPS

BACKGROUND OF THE INVENTION

The present invention is a device for loosening metal screw caps. Many persons have difficulty in unscrewing the caps on jars, bottles, and similar containers. To help alleviate this difficulty several devices have been described which aid one's grip while unscrewing a cap. Examples are the flexible sheet with suction cups disclosed by Cleveland in U.S. Pat. No. 2,235,313 and the clamping device disclosed by Vollers in U.S. Pat. No. 4,509,784. A disadvantage common to these devices is that the user must still provide all of the energy needed to loosen and unscrew the cap. Motorized devices, such as that disclosed by Grabarski et al. in U.S. Pat. No. 4,519,276, which automatically unscrew a cap are relatively complex and expensive.

It would be desirable to have a simple device which loosens a screw cap before a user must expend any effort to unscrew the cap.

SUMMARY OF THE INVENTION

The present invention provides a relatively simple device for loosening a metal screw cap with heat by disclosing a housing able to fit over a screw cap and heating means within the housing which can sufficiently heat the screw cap so that it is loosened. In the preferred embodiment of the invention, the housing comprises an outer wall and an inner wall, which define a chamber therebetween. The outer wall is cylindrical, with top and bottom ends. The inner wall starts at the bottom end of the outer wall with substantially the same diameter as the outer wall, is conical for a portion of the distance to the top end of the outer wall, and is cylindrical for the remainder of the distance. The heating means in the preferred embodiment is a magnetizing coil of wire wound around the inner wall which induces a current in a metal screw cap when the device is placed over the screw cap and the coil is powered.

DESCRIPTION OF THE PREFERRED EMBODIMENT

Figure 1:
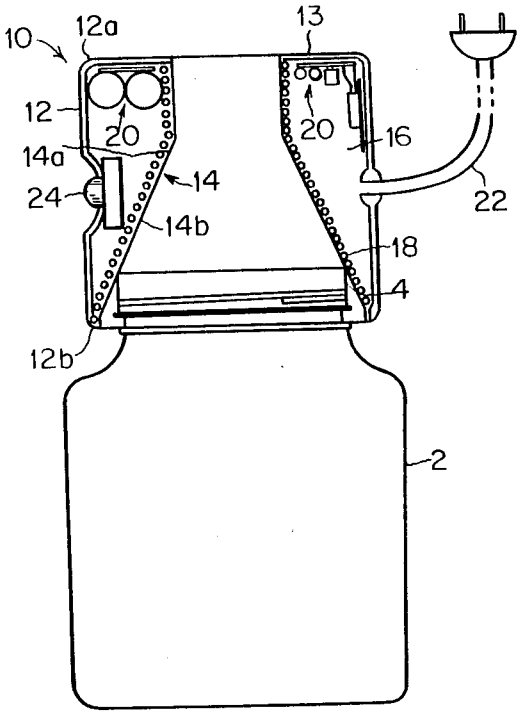
FIG. 1 is a cross-sectional view of the preferred embodiment of the present invention.
Figure 2:
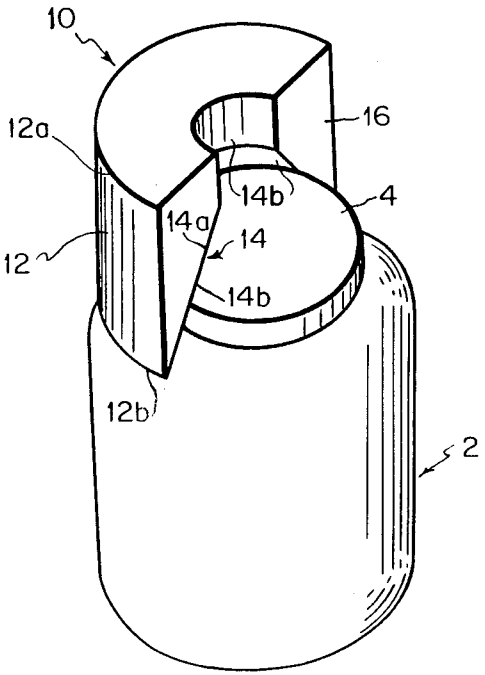
FIG. 2 is a perspective cross-sectional view of the preferred embodiment.

FIG. 1 shows a device according to the present invention in contact with a jar 2 having a metal screw cap 4. The device includes a housing 10 comprising an outer wall 12 and an inner wall 14. Outer wall 12 is cylindrical and has a top end 12*a* and a bottom end 12*b*. A cover 13 closes the housing at the top end of the outer wall. Inner wall 14 is inside and concentric with outer wall 12, has substantially the same diameter as outer wall 12 at bottom end 12*b*, is conical for a portion of the distance to top end 12*a*, and is cylindrical for the remainder of that distance. Inner wall 14 is connected to outer wall 12 at bottom end 12*b* and to a cover 13 which closes housing 10 at top end 12*a*. This configuration of the inner wall, which may be better understood with reference to FIG. 2, forms a chamber 16 between the inner and outer walls and allows the device to be used with containers such as jars and bottles of varying sizes.

Inner wall 14 has an outside surface 14*a* and an inside surface 14*b*. A magnetizing coil of wire 18 is wound around outside surface 14*a*. Inside surface 14*b*, which contacts screw cap 4, can be made of a material such as rubber to frictionally engage screw cap 4 once it is loosened to aid in removing the screw cap.

Electrical components 20, located inside chamber 16 and attached to outer wall 12, receive an alternating current via power cord 22 and supply it to magnetizing coil 18 when push button switch 24 is depressed. Electrical components 20 may be standard inverters, oscillators, or multivibrators, or any other known method for providing a current for induction heaters.

The operation of the device according to the present invention is as follows. A user grasps and places housing 10 over metal screw cap 4 on jar 2 so that inside surface 14*b* contacts screw cap 4. When power cord 22 is connected to a power source and push button switch 24 is depressed, a current flows through electrical components 20 to magnetizing coil 18. This causes the coil to produce a magnetic field which in turn creates electric currents in metal screw cap 4. This heats and expands the screw cap, thus loosening it, without appreciably heating the contents of jar 2. The screw cap may then be easily removed, either by hand or with the aid of the rubber inside surface 14*b* by rotating housing 10 while the inside surface remains in contact with the screw cap.

The frequency of the current supplied to magnetizing coil 18 can be from 60 Hz to 500 kHz, but because lower frequencies require a magnetic core for proper operation and higher frequencies create radio interference, a frequency range of about 100–200 kHz is preferred.

In order to provide ventilation for the device, outer wall 12 or cover 13 or both may include holes or mesh. The device may also be provided with a pole or a handle to facilitate turning the device to unscrew a cap.

While the method of using a magnetizing coil to induce high currents in a metal screw cap is preferred, it is not the only method for heating a cap so that it is loosened. Among other methods, an electrical heating element may be placed directly in contact with the metal cap, a radiant infrared source may be used to heat the cap, or a high current could be passed directly through the cap using, for example, carbon brushes.

I claim:

1. A device for loosening a metal screw cap affixed to a container comprising:

a housing adapted to contact the screw cap; and heating means, disposed in the housing, capable of sufficiently heating the screw cap so that it is loosened.

2. A device as claimed in claim 1, wherein the heating means comprises induction means for inducing a current in the screw cap.

3. A device as claimed in claim 2, wherein the housing comprises:

a cylindrical outer wall having a top end and a bottom end;

a cover which closes the housing at the top end of the outer wall; and an inner wall inside and concentric with the outer wall, thus defining a chamber between the inner and outer walls, the inner wall having substantially the same diameter as the outer wall at the bottom end of the outer wall and being conical from the bottom end of the outer wall for a portion of the distance to the top end of the outer wall and cylindrical for the remainder of the distance, the inner wall being connected to the bottom end of the outer wall and the cover.

4. A device as claimed in claim 3, wherein the inner wall comprises an outside surface and an inside surface and the induction means comprises a magnetizing coil of wire wound around the outside surface of the inner wall.

5. A device as claimed in claim 4, wherein the inside surface of the inner wall is made of a material capable of frictionally engaging the screw cap.

* * * * *